US009263822B2

(12) United States Patent
Wu et al.

(10) Patent No.: US 9,263,822 B2
(45) Date of Patent: Feb. 16, 2016

(54) WIRE TERMINAL STRUCTURE

(71) Applicant: SWITCHLAB INC., New Taipei City (TW)

(72) Inventors: Chih-Yuan Wu, New Taipei (TW); Wei-Chi Chen, New Taipei (TW); Shih-Chung Liu, New Taipei (TW); Shao-Te Chang, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/468,523

(22) Filed: Aug. 26, 2014

(65) Prior Publication Data

US 2015/0064950 A1 Mar. 5, 2015

(30) Foreign Application Priority Data

Aug. 30, 2013 (TW) ..... 102216398 U

(51) Int. Cl.

| | |
|---|---|
| ***H01R 13/193*** | (2006.01) |
| ***H01R 13/52*** | (2006.01) |
| ***H01R 4/48*** | (2006.01) |
| ***H01R 13/24*** | (2006.01) |
| ***H01R 13/629*** | (2006.01) |

(52) U.S. Cl.

CPC ..... *H01R 13/52* (2013.01); *H01R 4/4827* (2013.01); *H01R 4/4836* (2013.01); *H01R 13/2407* (2013.01); *H01R 13/629* (2013.01)

(58) Field of Classification Search

CPC .... H01R 13/193; H01R 4/4818; H01R 13/20; H01R 4/4836

See application file for complete search history.

(56) References Cited

U.S. PATENT DOCUMENTS

| | | | | |
|---|---|---|---|---|
| 3,668,610 | A * | 6/1972 | Flanagan | 439/268 |
| 4,973,263 | A * | 11/1990 | Nielsen | 439/438 |
| 5,410,257 | A * | 4/1995 | Swaffield | 324/756.02 |
| 8,262,405 | B1 * | 9/2012 | Bishop | 439/439 |
| 2014/0242833 | A1 * | 8/2014 | Mostoller et al. | 439/438 |

* cited by examiner

*Primary Examiner* — Gary Paumen
(74) *Attorney, Agent, or Firm* — Rosenberg, Klein & Lee

(57) ABSTRACT

A wire terminal structure capable of fully enclosing internal components to prevent external dust or impurity from entering the insulation case to affect the normal operation thereof. The wire terminal structure includes an insulation case and a conductive holding frame disposed in the case. The case is formed with a wire socket and a press window. The conductive holding frame has an elastic holding member corresponding to the wire socket. The elastic holding member is formed with a holding mouth. A push section is disposed on the elastic holding member corresponding to the press window. A pushbutton is elastically movably disposed in the press window between the press window and the push section. The pushbutton is spaced from the case. When an external force is applied to the pushbutton, the pushbutton is elastically moved to push the push section and open the holding mouth.

27 Claims, 6 Drawing Sheets

WIRE TERMINAL STRUCTURE

BACKGROUND OF THE INVENTION

1. Field of the Invention

The present invention relates generally to an improved wire terminal structure, and more particularly to a wire terminal structure for the wire connected to an electronic component such as an LED. The wire terminal structure is capable of fully enclosing internal components to prevent external dust or impurity from entering the insulation case to affect the normal operation thereof.

2. Description of the Related Art

A wire terminal or so-called connector is used to connect the metal conductive wires (electrical wires) between electronic components or connect the conductive wires between electronic components and circuit board. The electronic components can be a resistor, a capacitor, an inductor, an LED, a transformer, a liquid crystal panel, a touch panel or the like. The wire terminal serves to transmit power or electronic signal to facilitate the installation and layout of the internal circuit board and electronic components of an electronic product or apparatus.

Currently, there are various wire terminals on the market. In general, the conventional wire terminal has an insulation case and multiple conductive holding frames enclosed in the insulation case. The conductive holding frame is made of conductive metal material, having several elastic holding members for holding the wires of external electronic components and several soldering pins exposed to outer side of the case. The wire terminal is soldered on a circuit board via the soldering pins. In addition, the case is formed with a wire socket. The wire of the external electronic component can be plugged through the wire socket into the case and clamped by a holding mouth of the elastic holding member.

In order to easily extract the wire from the holding mouth of the elastic holding member of the wire terminal for replacement of the circuit board or electronic component or maintenance/reparation of the electronic product or apparatus, the elastic holding member of the wire terminal is formed with a push section for elastically opening the holding mouth so as to release the wire. For example, a conventional skill discloses a control device for electrical wire holder. The electrical wire holder (the elastic holding member of the conductive holding frame) has a slide aid slope (the push section) for elastically opening the electrical wire holder to release the external wire. A press arm is integrally formed on the insulation case corresponding to the slide aid slope. In use, a force is applied to an outer side of the press arm to inward elastically bend the press arm to touch the slide aid slope. At this time, the electrical wire holder is elastically forcedly opened in a direction reverse to the holding force. Thereafter, the wire can be easily extracted out of the case.

However, according to said conventional skill, the press arm is integrally formed on the insulation case and the stress is likely to concentrate on the bending junction between the press arm and the insulation case. The insulation case is generally made of plastic material so that the press arm is very likely to break. Therefore, the reliability and durability of such wire terminal are poor.

Moreover, when the press arm is pressed with a force, the press arm needs to elastically swing to touch the slide aid slope. In the precondition that the press arm is integrally formed on the insulation case, a gap obviously exists between the press arm and the insulation case so that the insulation case will not interfere with the press arm when elastically swinging. When the press arm is integrally formed on the insulation case by means of in-mold injection molding, the gap is naturally formed between the press arm and the insulation case. As a result, the external dust, impurity and moisture are very likely to go through the gap into the insulation case to affect the normal operation of the wire terminal and shorten the lifetime thereof.

SUMMARY OF THE INVENTION

It is therefore a primary object of the present invention to provide an improved wire terminal structure to overcome the shortcomings of the conventional wire terminal, which is capable of fully enclosing internal components to prevent external dust or impurity from entering the insulation case to affect the normal operation thereof.

To achieve the above and other objects, the wire terminal structure of the present invention includes an insulation case and a conductive holding frame disposed in the case. The case is formed with a wire socket and a press window. The conductive holding frame has an elastic holding member corresponding to the wire socket, The elastic holding member is formed with a holding mouth. A push section is disposed on the elastic holding member corresponding to the press window. A pushbutton is elastically movably disposed in the press window between the press window and the push section. The pushbutton is spaced from the case. When an external force is applied to the pushbutton, the pushbutton is elastically moved to push the push section and open the holding mouth.

In the above wire terminal structure, the pushbutton is supported by an elastic member and elastically movably disposed between the press window and the push section.

In the above wire terminal structure, the elastic member is a swing member extending from the conductive holding frame to the press window.

In the above wire terminal structure, the push section is formed with a guide slope directed to the press window. The pushbutton is formed with an inclined push face directed to the guide slope.

In the above wire terminal structure, the elastic holding member has two symmetrical holding arms formed on two sides of the conductive holding frame. The holding arms are respectively formed with the symmetrical guide slopes. The inclined push faces are symmetrically formed on two sides of the pushbutton and correspondingly positioned between the two guide slopes.

In the above wire terminal structure, a recess is formed on the pushbutton and exposed to the press window. The recess facilitates the application of a hand tool such as an awl, a screwdriver or a needle to the pushbutton for pressing the same.

In the above wire terminal structure, a transverse arm is disposed on a section of the elastic holding member distal from the holding mouth. The swing member is disposed on the transverse arm.

In the above wire terminal structure, the swing member is formed with at least one bending section to provide elasticity for the swing member.

In the above wire terminal structure, the conductive holding frame is formed with at least one soldering pin extending to outer side of the case.

In the above wire terminal structure, the pushbutton is supported by the elastic member integrally formed on the conductive holding frame or supported by an elastic member located on the case.

In comparison with the conventional wire terminal, the present invention has the following advantages:

1. The swing member of the elastic member is disposed on or integrally formed on the conductive holding frame to overcome the shortcoming of the conventional device in which the press arm is integrally formed on the insulation case. Therefore, the possibility of breakage of the press arm is greatly lowered. In this case, the reliability and durability of the wire terminal structure are enhanced.
2. The swing member of the elastic member is not integrally formed on the case and the pushbutton is movably disposed in the press window to block the press window between the interior and exterior of the case. This can enhance the enclosure of the case to the internal conductive holding frame. Therefore, the possibility of entrance of external dust, impurity or moisture through the gap between the conventional press arm and the insulation case into the case is greatly lowered. This ensures the normal operation of the wire terminal and enhances the durability of the wire terminal and prolongs the lifetime thereof.
3. The swing member is disposed at the junction between the elastic holding member and the conductive holding frame so that the conductive holding frame and the swing member integrated. The conductive holding frame is generally made of metal material to have electrical conductivity. Therefore, the swing member can be made of the waste material left after the conductive holding frame is formed. This can save the manufacturing cost.
4. The swing member is disposed at the junction between the elastic holding member and the conductive holding frame. In contrast, the conventional press arm is disposed on the case in adjacency to the slide aid slope. In condition that the volume of the case of the present invention is equal to that of the case of the conventional device, the length of the swing member is obviously longer than the length of the conventional press arm. This can reduce the deformation of the swing member when pressed and bent. Therefore, the possibility of breakage of the swing member is lowered. In addition, the swing member can be pressed with less strength.

The present invention can be best understood through the following description and accompanying drawings, wherein:

DETAILED DESCRIPTION OF THE PREFERRED EMBODIMENTS

Figure 1:
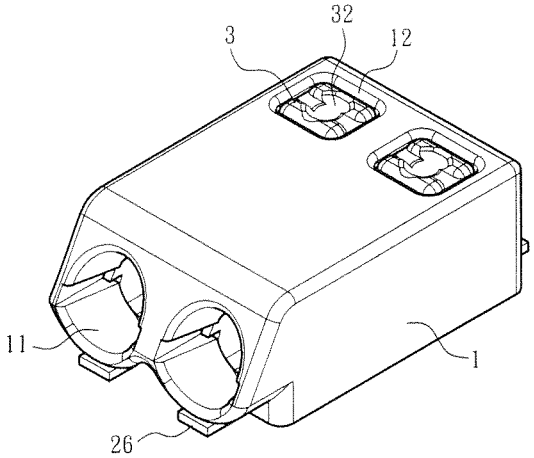
FIG. 1 is a perspective assembled view of a preferred embodiment of the present invention.
Figure 2:
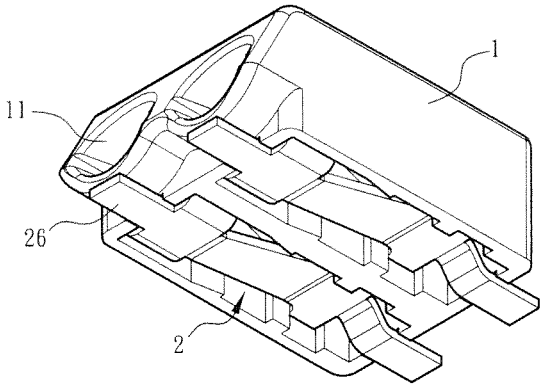
FIG. 2 is a bottom perspective view of the preferred embodiment of the present invention according to FIG. 1.
Figure 3:
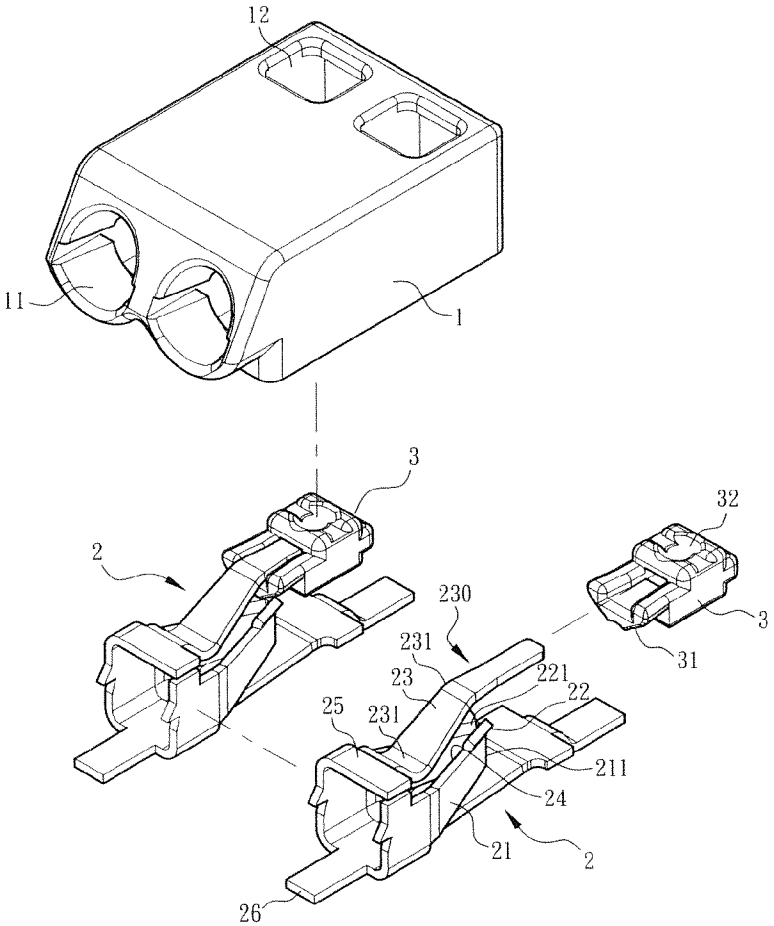
FIG. 3 is a perspective exploded view of the preferred embodiment of the present invention according to FIG. 1.
Figure 4:
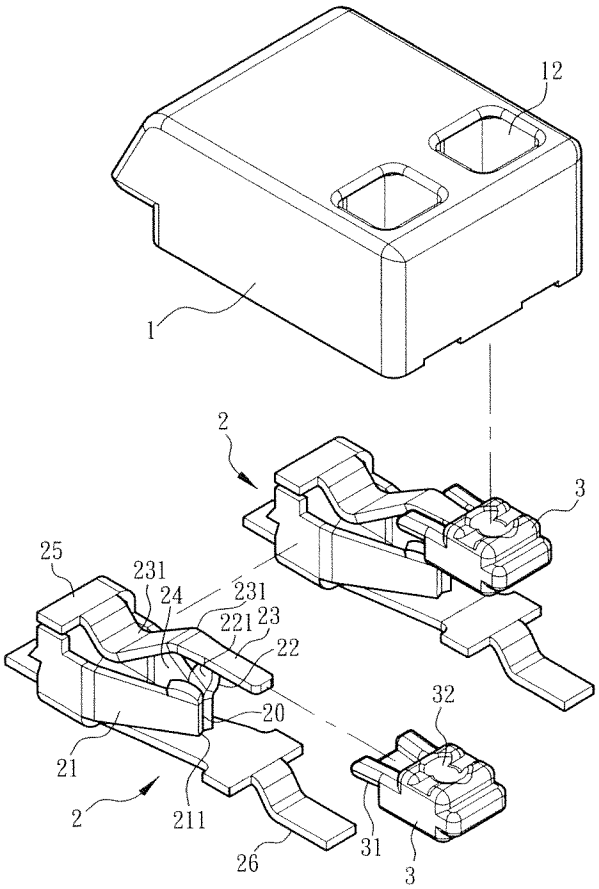
FIG. 4 is a perspective exploded view according to FIG. 3, seen from another angle.
Figure 5:
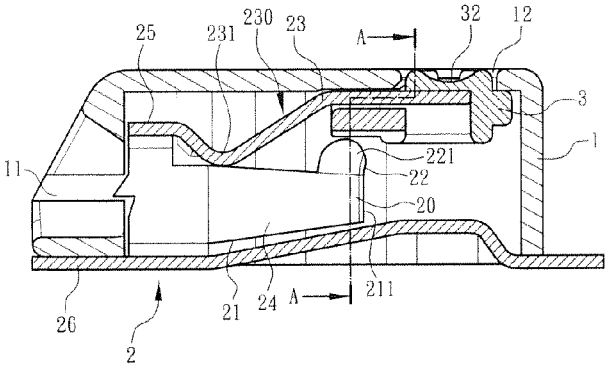
FIG. 5 is a side sectional view of the preferred embodiment of the present invention according to FIG. 1.

Please refer to FIGS. 1 to 8. FIG. 1 is a perspective assembled view of a preferred embodiment of the present invention. FIG. 2 is a bottom perspective view of the preferred embodiment of the present invention according to FIG. 1. FIG. 3 is a perspective exploded view of the preferred embodiment of the present invention according to FIG. 1. FIG. 4 is a perspective exploded view according to FIG. 3, seen from another angle. FIG. 5 is a side sectional view of the preferred embodiment of the present invention according to FIG. 1.

Figure 6:
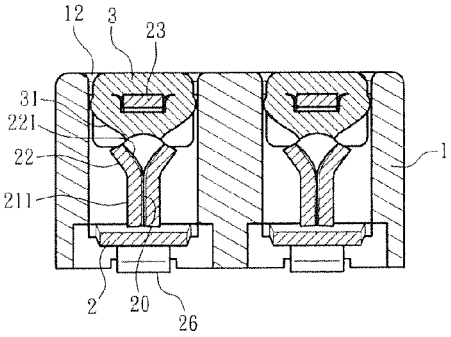
FIG. 6 is a sectional view taken along line A-A of FIG. 5.
Figure 7:
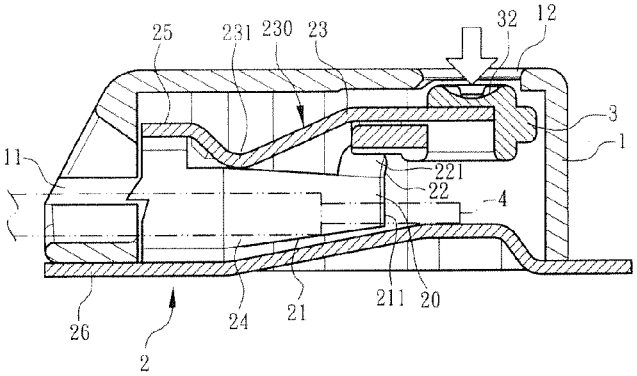
FIG. 7 is a sectional view according to FIG. 5, showing the use of the present invention.
Figure 8:
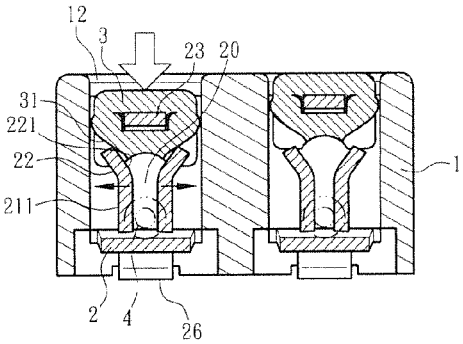
FIG. 8 is a sectional view according to FIG. 6, showing the use of the present invention.

FIG. 6 is a sectional view taken along line A-A of FIG. 5. FIG. 7 is a sectional view according to FIG. 5, showing the use of the present invention. FIG. 8 is a sectional view according to FIG. 6, showing the use of the present invention.

As shown in the drawings, the wire terminal structure of the present invention includes an insulation case 1 and a conductive holding frame 2 disposed in the case 1. One end of the case 1 is formed with a wire socket 11. A top section of the case 1 is formed with a press window 12. The conductive holding frame 2 has an elastic holding member 21 corresponding to the wire socket 11. The elastic holding member 21 is formed with a holding mouth 20. A push section 22 is disposed on top section of the rear end of the elastic holding member 21 corresponding to the press window 12.

A pushbutton 3 is elastically movably disposed in the press window 12 between the press window 12 and the push section 22. The pushbutton 3 is spaced from the case 1. When an external force is applied to the pushbutton 3, the pushbutton 3 is elastically moved to push the push section 22 and open the holding mouth 20.

In practice, the pushbutton 3 is supported by an elastic member 230 and elastically movably disposed between the press window 12 and the push section 22.

The elastic member 230 is a swing member 23 extending from the conductive holding frame 2 to the press window 12.

The conductive holding frame 2 can be made of a metal plate by means of bending the metal plate. Accordingly, the elastic holding member 21 and the swing member 23 of the elastic member 230 are both elastic.

One end of the swing member 23 of the elastic member 230 is disposed on the conductive holding frame 2. The other end of the swing member 23 extends to a posit ion between the press window 12 and the push section 22, whereby the swing member 23 has the form of a cantilever.

The pushbutton 3 is disposed at rear end of the swing member 23 and supported by the rear end of the swing member 23, whereby the pushbutton 3 is elastically movably positioned in the press window 12.

The push section 22 is formed with a guide slope 221 directed to the press window 12. The bottom of the pushbutton 3 is formed with an inclined push face 31 directed to the guide slope 221.

In practice, the elastic holding member 21 has two symmetrical holding arms 211 formed on two sides of the conductive holding frame 2. The holding arms 211 are respectively formed with the symmetrical guide slopes 221 arranged in V-form.

The swing member 23 extends to a position between the two guide slopes 221 of the elastic holding member 21. The number of the inclined push faces 31 of the pushbutton 3 can be two. The inclined push faces 31 are symmetrically formed on two sides of the pushbutton 3 and correspondingly positioned between the two guide slopes 221.

The two elastic holding members 21 are disposed on the conductive holding frame 2 in V-form. Therefore, the inner faces 24 of the elastic holding members 21 are directed to the wire socket 11.

A recess 32 is formed on the top section of the pushbutton 3 and exposed to the press window 12. The recess 32 facilitates the application of a hand tool such as an awl, a screwdriver or a needle to the pushbutton 3 for pressing the same.

The base section of the swing member 23 of the elastic member 230 is disposed at the junction between the elastic holding member 21 and the conductive holding frame 2. A transverse arm 25 is disposed on a section of the elastic holding member 21 distal from the holding mouth 20. The transverse arm 25 extends between the elastic holding member 21. The swing member 23 is disposed on the transverse arm 25 to extend to the holding mouth 20.

In practice, the middle section of the swing member 23 is formed with at least one bending section 231. The bending section 231 provides extra elasticity for the swing member 23.

In practice, each of two ends of the conductive holding frame 2 is formed with at least one soldering pin 26 extending to outer side of the bottom of the case 1.

In practice, the swing member 23 can be disposed on the conductive holding frame 2 by means of external connection. Alternatively, the swing member 23 can be integrally formed on the conductive holding frame 2.

The pushbutton 3 is supported by the elastic member 230 integrally formed on the conductive holding frame 2. Alternatively, the pushbutton 3 can be supported by another elastic member located on the case 1.

In practice, the case 1 can have one single set of conductive holding frame 2, wire socket 11 and press window 12. Alternatively, the case 1 can have multiple sets of conductive holding frames 2, wire sockets 11 and press windows 12.

According to the above arrangement, the soldering pins 26 can be previously soldered on a circuit board to fix the case 1 on the circuit board. Alternatively, the soldering pins 26 can be soldered on any other electronic product or apparatus needing to connect with the wire terminal.

In common use, the wire 4 connected to an electronic component such as a resistor, a capacitor, an inductor, an LED, a transformer, a liquid crystal panel or a touch panel can be plugged through the wire socket 11 into the case 1. At this time, the wire 4 pushes the inner faces of the elastic holding member 21 and elastically biases the holding arms 211 of the elastic holding member 21 to two sides of the conductive holding frame 2 so as to open the holding mouth 20. When the wire 4 passes through the holding mouth 20, the wire 4 is elastically clamped between the holding arms 211 and located in the holding mouth 20 of the elastic holding member 21.

When it is desired to take the wire 4 out of the wire terminal, a hand tool such as an awl, a screwdriver or a needle can be used to extend into the press window 12 to press down the pushbutton 3. At this time, the swing member 23 of the elastic member 230 is elastically bent toward the elastic holding member 21. Accordingly, the inclined push faces 31 of the bottom of the pushbutton 3 will move downward to touch and push the guide slopes 221 of the push sections 22 of the elastic holding member 21. Under such circumstance, the push sections 22 will drive the holding arms 211 to elastically move toward two sides of the conductive holding frame 2 to open the holding mouth 20. At this time, the wire 4 can be successfully taken out between the holding arms 211.

When the pushbutton 3 is released from the external pressing force, the swing member 23 elastically drives the pushbutton 3 toward the press window 12 to elastically restore to its home position. At the same time, the holding arms 211 of the elastic holding member 21 also elastically move to the center of the conductive holding frame 2 and restore to their home positions to close the holding mouth 20.

Accordingly, the swing member 23 of the elastic member 230 is disposed on or integrally formed on the conductive holding frame 2 to overcome the shortcoming of the conventional device in which the press arm is integrally formed on the insulation case. Therefore, the possibility of breakage of the press arm is greatly lowered. In this case, the reliability and durability of the wire terminal structure are enhanced.

In addition, the swing member 23 of the elastic member 230 is not integrally formed on the case 1 and the pushbutton 3 is movably disposed in the press window 12 to block the press window 12 between the interior and exterior of the case 1. This can enhance the enclosure of the case 1 to the internal conductive holding frame 2. Therefore, the possibility of entrance of external dust, impurity or moisture through the gap between the conventional press arm and the insulation case into the case is greatly lowered. This ensures the normal operation of the wire terminal and enhances the durability of the wire terminal and prolongs the lifetime thereof.

It should be noted that the swing member 23 is disposed at the junction between the elastic holding member 21 and the conductive holding frame 2 so that the conductive holding frame 2 and the swing member 23 integrated. The conductive holding frame 2 is generally made of metal material to have electrical conductivity. Therefore, the swing member 23 can be made of the waste material left after the conductive holding frame 2 is formed. This can save the manufacturing cost.

Furthermore, the swing member 23 is disposed at the junction between the elastic holding member 21 and the conductive holding frame 2. In contrast, the conventional press arm is disposed on the case in adjacency to the slide aid slope. In condition that the volume of the case 1 of the present invention is equal to that of the case of the conventional device, the length of the swing member 23 is obviously longer than the length of the conventional press arm. This can reduce the deformation of the swing member 23 when pressed and bent. Therefore, the possibility of breakage of the swing member 23 is lowered. In addition, the swing member 23 can be pressed with less strength.

In conclusion, the present invention can overcome the shortcomings of the conventional wire terminal in which the press arm is connected with the insulation case and the stress is likely to concentrate on the junction between the press arm and the case to increase the possibility of breakage of the press arm. As a result, the reliability and durability of the conventional wire terminal structure are poor. Also, in the conventional wire terminal, the press arm is integrally formed on the insulation case so that a gap obviously exists between the press arm and the insulation case. In this case, the external dust, impurity or moisture is very likely to go through the gap into the insulation case. This will affect the normal operation of the wire terminal and shorten the lifetime thereof.

The above embodiments are only used to illustrate the present invention, not intended to limit the scope thereof. Many modifications of the above embodiments can be made without departing from the spirit of the present invention.

What is claimed is:

1. A wire terminal structure comprising an insulation case and a conductive holding frame disposed in the case, the case being formed with a wire socket and a press window, the conductive holding frame having an elastic holding member corresponding to the wire socket, the elastic holding member being formed with a holding mouth, a push section being disposed on the elastic holding member corresponding to the press window, the wire terminal structure being characterized in that a pushbutton is elastically movably disposed in the press window between the press window and the push section, the pushbutton being supported by an elastic member and having an opening formed therein receiving a distal end of the elastic member, the pushbutton being spaced from the case and having a top section extending into the press window, whereby when an external force is applied to the pushbutton, the pushbutton is elastically moved to push the push section and open the holding mouth.

2. The wire terminal structure as claimed in claim 1, wherein the elastic member is a swing member extending from the conductive holding frame to the press window.

3. The wire terminal structure as claimed in claim 1, wherein the push section is formed with a guide slope directed to the press window, the pushbutton being formed with an inclined push face directed to the guide slope.

4. The wire terminal structure as claimed in claim 2, wherein the push section is formed with a guide slope directed to the press window, the pushbutton being formed with an inclined push face directed to the guide slope.

5. The wire terminal structure as claimed in claim 3, wherein the elastic holding member has two symmetrical holding arms formed on two sides of the conductive holding frame, the holding arms being respectively formed with the symmetrical guide slopes, the inclined push faces being symmetrically formed on two sides of the pushbutton and correspondingly positioned between the two guide slopes.

6. The wire terminal structure as claimed in claim 4, wherein the elastic holding member has two symmetrical holding arms formed on two sides of the conductive holding frame, the holding arms being respectively formed with the symmetrical guide slopes, the inclined push faces being symmetrically formed on two sides of the pushbutton and correspondingly positioned between the two guide slopes.

7. The wire terminal structure as claimed in claim 1, wherein a recess is formed in the top section of the pushbutton and is exposed to the press window.

8. The wire terminal structure as claimed in claim 2, wherein a recess is formed in the top section of the pushbutton and is exposed to the press window.

9. The wire terminal structure as claimed in claim 3, wherein a recess is formed in the top section of the pushbutton and is exposed to the press window.

10. The wire terminal structure as claimed in claim 2, wherein a transverse arm is disposed on a section of the elastic holding member distal from the holding mouth, the swing member being disposed on the transverse arm.

11. The wire terminal structure as claimed in claim 2, wherein the swing member is formed with at least one bending section to provide elasticity for the swing member.

12. The wire terminal structure as claimed in claim 10, wherein the swing member is formed with at least one bending section to provide elasticity for the swing member.

13. The wire terminal structure as claimed in claim 1, wherein the conductive holding frame is formed with at least one soldering pin extending to outer side of the case.

14. The wire terminal structure as claimed in claim 2, wherein the conductive holding frame is formed with at least one soldering pin extending to outer side of the case.

15. The wire terminal structure as claimed in claim 3, wherein the conductive holding frame is formed with at least one soldering pin extending to outer side of the case.

16. The wire terminal structure as claimed in claim 4, wherein the conductive holding frame is formed with at least one soldering pin extending to outer side of the case.

17. The wire terminal structure as claimed in claim 5, wherein the conductive holding frame is formed with at least one soldering pin extending to outer side of the case.

18. The wire terminal structure as claimed in claim 10, wherein the conductive holding frame is formed with at least one soldering pin extending to outer side of the case.

19. The wire terminal structure as claimed in claim 11, wherein the conductive holding frame is formed with at least one soldering pin extending to outer side of the case.

20. The wire terminal structure as claimed in claim 1, wherein the elastic member is integrally formed on the conductive holding frame.

21. The wire terminal structure as claimed in claim 2, wherein the elastic member is integrally formed on the conductive holding frame.

22. The wire terminal structure as claimed in claim 3, wherein the elastic member is integrally formed on the conductive holding frame.

23. The wire terminal structure as claimed in claim 5, wherein the elastic member is integrally formed on the conductive holding frame.

24. The wire terminal structure as claimed in claim 10, wherein the elastic member is integrally formed on the conductive holding frame.

25. The wire terminal structure as claimed in claim 11, wherein the elastic member is integrally formed on the conductive holding frame.

26. The wire terminal structure as claimed in claim 13, wherein the elastic member is integrally formed on the conductive holding frame.

27. The wire terminal structure as claimed in claim 1, wherein the elastic member is located on the case.

* * * * *